US005445687A

United States Patent [19]

Sukegawa et al.

[11] Patent Number: 5,445,687

[45] Date of Patent: Aug. 29, 1995

[54] HOT WORKING MATERIAL OF CORROSION RESISTANT COPPER-BASED ALLOY

[75] Inventors: Tosuke Sukegawa; Yoshihito Shimoda, both of Nagano; Hisashi Tan, Osaka; Takahiro Tsuji, Osaka; Keiichiro Oishi, Osaka, all of Japan

[73] Assignees: Toyo Valve Co., Ltd., Tokyo; Sanbo Shindo Kogyo Co., Ltd., Osaka, both of Japan

[21] Appl. No.: 214,095

[22] Filed: Mar. 17, 1994

Related U.S. Application Data

[63] Continuation-in-part of Ser. No. 909,202, Jul. 6, 1992, abandoned.

[30] Foreign Application Priority Data

Nov. 14, 1991 [JP] Japan ..... 3-327047

[51] Int. Cl.[6] ..... C22C 9/08

[52] U.S. Cl. ..... 148/433; 420/471; 420/472; 148/680; 148/683

[58] Field of Search ..... 420/471, 472; 148/433, 148/680, 683

[56] References Cited

U.S. PATENT DOCUMENTS 4,101,317 7/1978 Okano ..... 148/433

FOREIGN PATENT DOCUMENTS 60-194035 10/1985 Japan .

*Primary Examiner*—David A. Simmons
*Assistant Examiner*—Sean Vincent
*Attorney, Agent, or Firm*—Griffin, Butler, Whisenhunt & Kurtossy

[57] ABSTRACT

A hot working material of corrosion resistant copper-based alloy having a metal composition of 61.0 weight percent to less than 63.0 weight percent copper, 1.0 weight percent to 3.5 weight percent lead, 0.7 weight percent to 1.2 weight percent tin, 0.2 weight percent to 0.7 weight percent nickel, 0.03 weight percent to 0.4 weight percent iron, 0.02 weight percent to 0.10 weight percent antimony, and 0.04 weight percent to 0.15 weight percent phosphorus, with the balance composed of zinc and inevitable accompanying impurities. The alloy is subjected to hot working and subsequent heat treatment at 500° C. to 600° C. for 30 minutes to 3 hours and sufficient that the alloy has an α single-phase structure and addition elements are dispersed uniformly in the entire structure.

7 Claims, 9 Drawing Sheets

HOT WORKING MATERIAL OF CORROSION RESISTANT COPPER-BASED ALLOY

This application is a continuation-in-part of prior application Ser. No. 07/909,202, filed on Jul. 6,1992, and now abandoned.

The present invention relates to a hot working material made of a copper-based alloy which is excellent in corrosion resistance, especially resistance to dezincification and grain boundary corrosion, and excellent in mechanical properties, e.g. machinability. The material is a hot worked material, e.g. hot extruded and hot forged, of extruded or drawn material, or pressure die-casting material, which has been heat treated by a specific heat treatment to an α single-phase material.

BACKGROUND OF THE INVENTION

In general, the art has widely used copper-based alloys, such as forging brass (CDA-C37700), free-cutting brass (CDA-C36000), naval brass (CDA-C46400), high-tensile brass (CDA-C67800), aluminum bronze (CDA-C61900), and the like.

These prior art copper-based alloys are, however, not satisfactory in regard to both corrosion resistance and machinability. For example, free-cutting brass bars, forging brass bars, etc., have the disadvantage that they are susceptible to dezincification corrosion in warm water, polluted water, or sea water, because of their high zinc contents. On the other hand, while naval brass bars, aluminum bronze bars, and high-tensile brass bars are considered to be excellent in general corrosion resistance, they have poor machinability and are unsatisfactory in resistance to specific dezincification and dealuminization corrosion conditions.

Thus, in recent years, the art has proposed copper-based alloys having improved resistance to dezincification corrosion, obtained by the addition of a very small amount of arsenic to those alloys, e.g. 65/35 brass-type or 60/40 brass-type copper-based alloys, examples of which are CDA-C33530, CDA-C35330, CDA-C48600, BS2874-CZ132, and the alloys disclosed in U.S. Pat. No. 3,963,526.

However, where a very small amount of arsenic is added to such alloys, e.g. 65/35 brass-type or 60/40 brass-type copper-based alloys, to reduce dezincification corrosion, impurities in the alloys, such as iron and manganese, must be limited to very small amounts. This is because arsenic is an element with high chemical activity, and when relatively large amounts of impurities, such as iron and manganese, are contained in the alloys, the arsenic is consumed by these impurities to produce compounds thereof. Thus, the amount of arsenic available to form a solid solution, as an effective element in the substrate of the copper-based alloys, becomes insufficient, thereby making it difficult to attain the desired resistance to dezincification corrosion.

Consequently, in order to limit the contents of iron, manganese, and the like to satisfactory low levels, for example to 0.1 weight percent to 0.2 weight percent or less, recycled materials, which have been commercially recovered, must correspondingly be limited in these alloys to small amounts. This results in the necessity to use relatively large amounts of raw materials having high purity. For this reason, the material cost of such alloys is high. On the other hand, when large amounts of recycled materials are used, the amount of these impurities becomes large, and a relatively large amount of arsenic must be used to compensate for the amount of arsenic consumed by these impurities.

This approach, however, gives rise to the following disadvantages. Because arsenic is an element which can readily cause segregation into grain boundaries, the sensitivity of the resulting alloys to intergranular corrosion may be significantly increased by the deposition of arsenic compounds of, for example, iron, manganese, and the like, into the grain boundary, thereby causing severe intergranular corrosion. Additionally, in some countries, such as Japan, the use of arsenic-containing materials has been subjected to drastic restrictions, in view of safety and health considerations, and, therefore, it is preferable to avoid the addition of arsenic to these alloys.

Thus, the art has made efforts to avoid or severely limit the necessity to use arsenic in such alloys, and other elements, rather than arsenic, have been proposed for reducing dezincification corrosion of such alloys.

In regard to copper-based alloys which reduce dezincification corrosion by the addition of elements other than arsenic, Hopper's metal (U.S. Pat. No. 3,404,977) and Okano's metal (U.S. Pat. No. 4,101,317) are notable examples. These alloys improve the resistance to dezincification corrosion by the contribution of tin and nickel, both of which are added to copper-zinc alloys in a relatively large amount.

Hopper's metal, however, is a casting alloy, and it is not well adapted to hot working, e.g. hot extrusion or forging. On the other hand, Okano's metal contains 1.2 to 2.0 weight percent tin, which is a relatively high content, and, depending upon the temperature condition in a hot working step, e.g. hot extrusion, the γ phase, constituted by Sn-rich Cu—Zn—Sn-type intermetallic compounds, will appear in the alloy. If such a γ phase appears, the alloy will have decreased toughness and exhibit brittleness, so that cracks may readily form at the time of such hot working. Moreover, tin is prone to cause segregation, and, therefore, it is difficult to stabilize the structure of the alloy. This results in a serious drawback in that the corrosion resistance of the alloy has a tendency to vary from part to part. This difficulty can be mitigated to a certain extent by adding a large amount of nickel, by conducting the hot working within an extremely narrow temperature range, and by a heat treatment over a long period of time. However, this mitigation causes the disadvantages of, for example, significantly deteriorated operating characteristics in the production of the alloy, which becomes a problem in quality control and production yield (or cost). Furthermore, the addition of large amounts of expensive tin and nickel is economically unsound.

It would, therefore, be of significant advantage to the art to provide corrosion-resistant copper-based alloys having a stable e single phase structure, excellent corrosion resistance (especially, resistance against dezincification corrosion and intergranular corrosion), mechanical properties, and machinability, but without the necessity to use arsenic and without the drawbacks, as explained above. It would be a further advantage to provide corrosion-resistant copper-based alloys which are easy to hot work, e.g. hot forging or hot extrusion, where quality control in the production process is not a problem, with high production yields, and which alloys have stable quality at a low cost.

It would be of further advantage to the art to provide corrosion-resistant copper-based alloys which are well suited for a wide range of applications, such as valve components (e.g. body, disc, stem, etc.), machinery parts, marine equipment, electric parts, shafts, pump shafts, bushes, tube-shaped members, plate-shaped members, and the like, because the alloys have excellent resistance to corrosion caused by warm water, polluted water, sea water, or the like, and also have excellent machinability and mechanical properties.

Finally it would be an advantage to the art to provide such corrosion-resistant copper-based alloys whose working scrap, such as cutting waste, can be reutilized as a material of bronze casting and the like.

SUMMARY OF THE INVENTION

The hot working material of the invention which solves the above-noted problems is a metal composition comprising 61.0 weight percent to less than 63.0 weight percent of copper, 1.0 weight percent to 3.5 weight percent of lead, 0.7 weight percent to 1.2 weight percent of tin, 0.2 weight percent to 0.7 weight percent of nickel, 0.03 weight percent to 0.4 weight percent of iron, 0.02 weight percent to 0.10 weight percent of antimony, and 0.04 weight percent to 0.15 weight percent of phosphorus, with the balance composed of zinc and inevitable accompanying impurities, and when an $\alpha$ single-phase structure is formed and additive elements which would otherwise be scattered unevenly in the crystal grain boundary are dispersed uniformly in the entire structure by a specific heat treatment after the hot working. Representative examples of the hot working material of the invention include an extruded material by hot extrusion of an ingot or a forged material by hot forging of extruded material or drawn material. In particular, a forged material of a practical shape, includes those used as parts (e.g. body, stem, etc.) of valves that require corrosion resistance, pipe joints and others.

DETAILED DESCRIPTION OF PREFERRED EMBODIMENTS OF THE INVENTION

Figure 1:
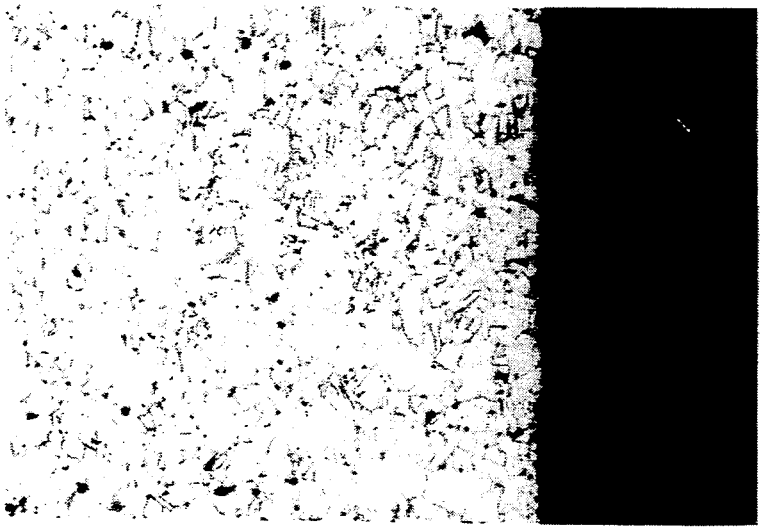
FIG. 1 is a photomicrograph showing the metal structure in normal cross-section magnified 200 times with respect to the exposed surface of hot working material No. 1 after heat treatment and after a dezincification corrosion test according to "ISO 6509".
Figure 2:
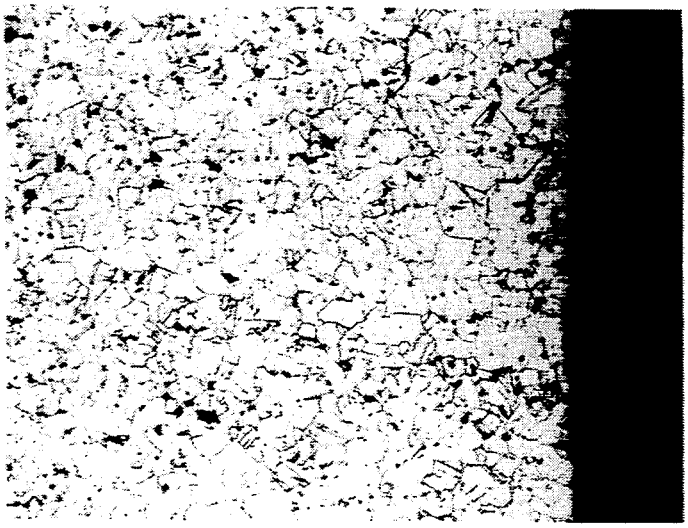
FIG. 2 is a photomicrograph showing the metal structure in normal cross-section magnified 200 times with respect to exposed surfaces of hot working material No. 2 after heat treatment and after the same corrosion test as described above.
Figure 3:
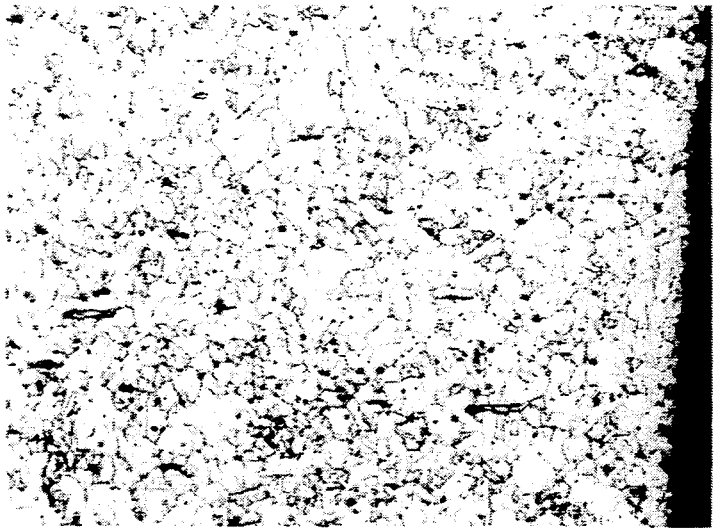
FIG. 3 is a photomicrograph showing the metal structure in normal cross-section magnified 200 times with respect to exposed surfaces of hot working material No. 12 after heat treatment and after the same corrosion test as described above.
Figure 4:
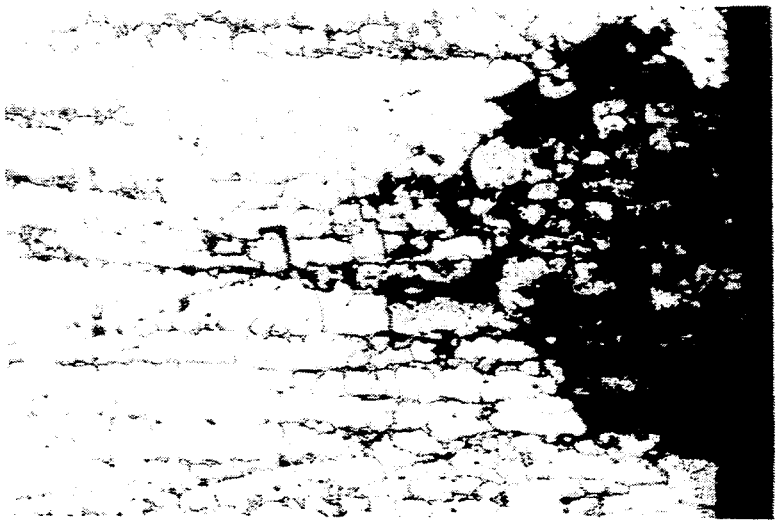
FIG. 4 is a photomicrograph showing the metal structure in normal cross-section magnified 200 times with respect to exposed surfaces of hot working material No. 1 before heat treatment and after the same corrosion test as described above.
Figure 5:
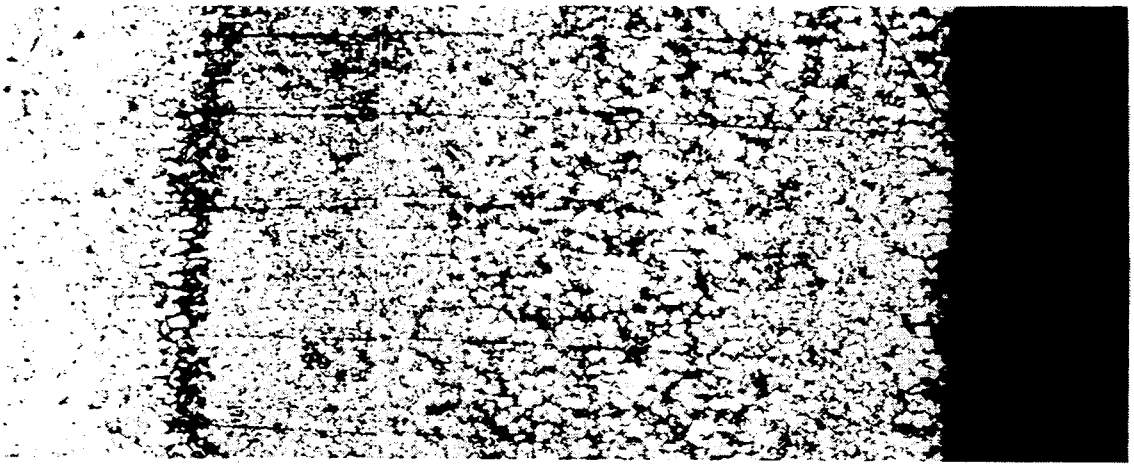
FIG. 5 is a photomicrograph showing the metal structure in normal cross-section magnified 100 times with respect to exposed surfaces of hot working material No. 7 without heat treatment and after the same corrosion test as described above.
Figure 6:
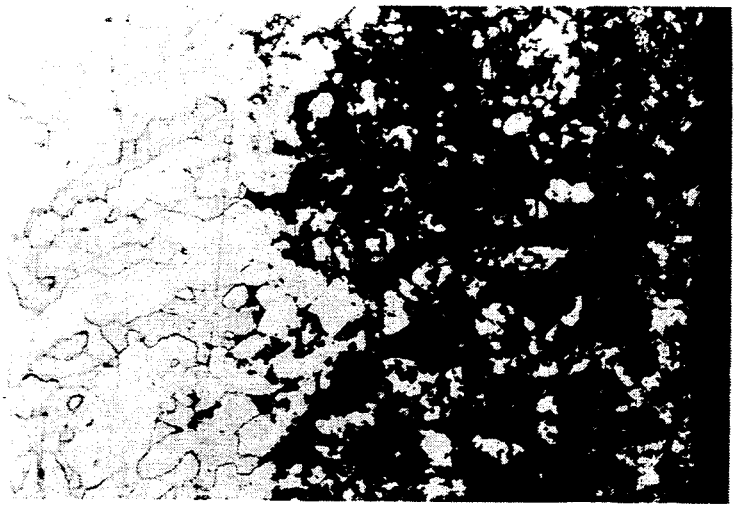
FIG. 6 is a photomicrograph showing the metal structure in normal cross-section magnified 100 times with respect to exposed surfaces of hot working material No. 8 without heat treatment and after the same corrosion test as described above.
Figure 7:
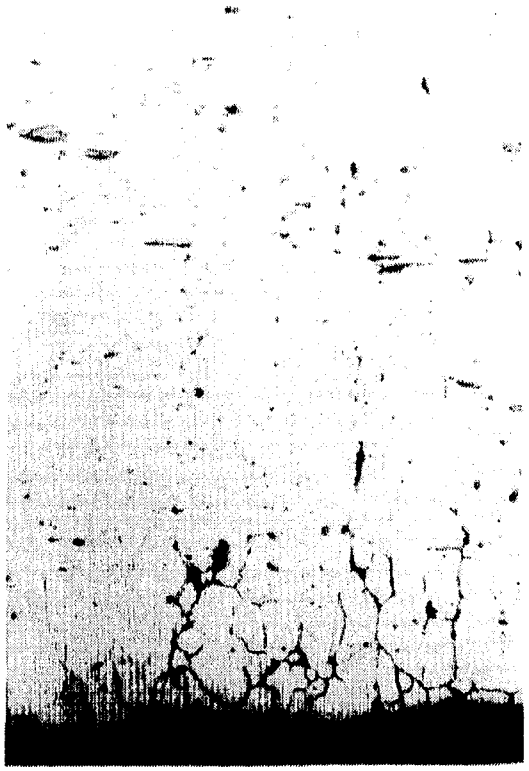
FIG. 7 is a photomicrograph showing the metal structure in normal cross-section magnified 200 times with respect to exposed surfaces of hot working material No. 10 after heat treatment and after the same corrosion test as described above.
Figure 8:
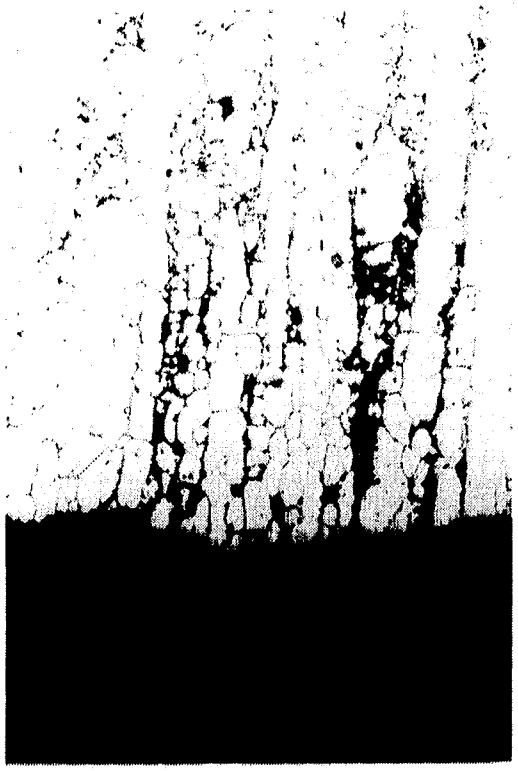
FIG. 8 is a photomicrograph showing the metal structure in normal cross-section magnified 200 times with respect to exposed surfaces of hot working material No. 11 after heat treatment and after the same corrosion test as described above.

As noted above, superior corrosion resistance and superior hot forging properties are necessary in order to effectively use hot working materials made from copper-based alloys in the present fields of use (for instance, valves used with corrosive water, hot water, waste water, and sea water) where ordinary brass cannot be used. This is because even if the corrosion resistance is good, if the hot forging properties are inferior, the products, in practical shapes, for instance valves, cannot be formed and result in difficulty in expanding the use to the fields where corrosion resistance is required. In this regard, it is noted that the hot forging properties are stressed because superiority in the hot forging properties means superiority in all the hot working properties such as hot extrusion properties and the like.

According to the present invention, in order to realize such use expansion, the copper content is selected mainly in consideration of the hot forging properties. In order to obtain the superior hot forging properties, it is necessary to achieve a large amount of the $\beta$ phase at the hot forging temperature range. More specifically, when the materials for forging (ingot, extrusion material, and others) are heated to the forging temperature (650° C.–800° C.), the alloy structure of the materials must be substantially changed, generally more than 50%, to the double phase structure ($\alpha+\beta$ phase structure) containing the $\beta$ phase, which is superior in high temperature ductility for hot forging purposes. The degree of superiority in high temperature ductility effected by the $\beta$ phase is determined by the content ratio between Cu and other addition elements, and not necessarily by the Cu content alone. But, if the Cu content is at or exceeds 63.0 weight percent, it is very difficult or impossible to change the structure to one having a $\beta$ phase of 50% or more at those forging temperatures. That is, a minimum necessary condition for the present invention is to limit the Cu content to less than 63.0 weight percent in order to change the structure to one having a $\beta$ phase of more than 50% in the above-mentioned forging temperature range. When the Cu content is at or exceeds 63.0 weight percent, it is practically impossible to change the structure to one having a $\beta$ phase of more than 50% in the forging temperature range, irrespective of the content ratio between Cu and Zn, Ni and other addition elements.

While if the Cu content is at 63.0 to 63.4 weight percent, it is theoretically possible to change to the double phase structure containing 50% or more of the $\beta$ phase as long as the forging temperature is maintained within an extremely narrow range near the upper limits of the above-mentioned forging temperature range. However, it is practically impossible to maintain the forging temperature within such a narrow range. Such a narrow range is beyond the control limits within which temperatures can be industrially (stably) maintained with conventional forging equipment. Thus, it is necessary that such an alloy, for practical use, exhibit good forging properties in the entire general forging temperature range (650° C.–800° C.) in order to be able to use such alloys in hot forging apparatus as they now stand, and which are currently installed and used at almost all factories around the world. If it were necessary to keep the temperatures within such a narrow hot forging temperature range, as mentioned above, the existing hot-forging apparatus could not be utilized.

On the other hand, to obtain excellent corrosion resistance, it is necessary to form an $\alpha$ single-phase structure of the alloy at ordinary ambient temperatures. For example, the dominance of the $\alpha$ phase in forged materials, extruded materials, or drawn materials, of brass is related to the nickel content. This dominance is generally limited to the case where the copper content is at least 62 weight percent, and to ensure an $\alpha$ single-phase structure, the copper content must be over 63 weight percent. However, as described below, by applying the present specific heat treatment after hot processing where the $\alpha$ and $\beta$ phase exist, it is possible to obtain thereby a stable $\alpha$ single-phase structure, when the copper content is less than 63 weight percent, but at least more than 61.0 weight percent, in combination with a synergistic effect with nickel. On the other hand, if the copper content is 63 weight percent or more, while the $\alpha$ phase may be obtained and the corrosion resistance can be enhanced, the tensile strength and hardness are lowered. Therefore, from the aspect of the corrosion resistance and mechanical properties, and considering that dezincification corrosion mainly occurs from a structure of phases other than the $\alpha$ phase (e.g. $\beta$ phase, etc.), it is necessary to provide a copper content and conditions for achieving a stable $\alpha$ phase structure after the present heat treatment and while not sacrificing the mechanical properties.

Taking these points into consideration, and further considering the economy including the relation with nickel, the copper content must be at least 61 weight percent but less than 63 weight percent. In particular, considering the relation with nickel, it is preferred to keep the total content of copper and nickel at 61.5 weight percent or more.

Tin is added in order to improve the corrosion resistance. While the tin content in the above-described Okano's metal is relatively large, i.e. 1.2 to 2.0 weight percent, through experiments it was found that a stable $\alpha$ phase structure is obtained, especially after heat treatment, when the amount of tin in the alloy is much smaller. Thus, satisfactory corrosion resistance can be obtained with these smaller amounts, especially with the nickel, antimony, and phosphorus contents, as described below. With an addition of less than 0.7 weight percent tin, a significant improvement in the corrosion resistance cannot be obtained. It was further found that with more than 1.2 weight percent of tin, the $\gamma$ phase, which is brittle, is prone to appear. Thus, the tin content should be between about 0.7 and 1.2 weight percent, which is also consistent with desired economy, since tin is an expensive metal.

Lead is added in order to improve the machinability of the alloy. With an addition of less than 1.0 weight percent lead, satisfactory machinability cannot be obtained, whereas with the addition of too much lead, the hot working, e.g. hot extrusion, in the production process is difficult. It is noted that the maximum amount of lead in the above-described Okano's metal is 2.0 weight percent. As described above, the minimum present content of copper is 61.0 weight percent, and, with this, the hot working, e.g. hot extrusion or hot forging, is easy and stably produced, even with a lead addition of more than 2.0 weight percent. However, with an addition of more than 3.5 weight percent lead, the elongation, impact value, and the like decrease. For this reason, the lead content should be between about 1.0 and 3.5 weight percent.

Nickel is added in order to improve the corrosion resistance by the synergistic effect with tin and to improve the mechanical properties of the alloy. Since nickel has a negative zinc equivalent, the $\alpha$ phase structure has increased volumes with increased amounts of nickel. Therefore, with the addition of nickel, it is possible to not only prevent an increase in the volume of the $\beta$ phase but also to prevent the appearance of an Sn-rich $\gamma$ phase, i.e. Cu—Zn—Sn-type intermetallic compounds, and this is true even when the copper content is as little as 61.0 weight percent. Heat treatment after hot working, e.g. hot extrusion, makes it possible to obtain a stable $\alpha$ phase structure and to improve the corrosion resistance, and particularly resistance against dezincification corrosion. Moreover, the addition of nickel makes it possible to obtain alloys with high mechanical strength, even though they have a stable $\alpha$ phase structure. However, with an addition of less than 0.2 weight percent nickel, such effects are minimal. On the other hand, there is no necessity for improvements in corrosion resistance and increased mechanical strength achieved by nickel contents above about 0.7 weight percent, and, in fact, there is a problem with higher contents from an economic point of view. For this reason, the nickel content should be between about 0.2 and 0.7 weight percent. Moreover, in consideration of the synergistic effect with tin, it is preferable that the combined total content of nickel and tin should be between about 1.0 and 1.6 weight percent.

Antimony is added in order to suppress the dezincification corrosion together with the addition of tin and phosphorus. Because antimony is an element with high chemical activity, it not only forms a solid solution in the substrate of the alloy, but also forms a solid solution together with lead to a certain extent, particularly in the case of lead-containing brass. Therefore, an effective amount of antimony must be determined in relation to the added amount of antimony forming a solid solution. According to the results of experiments, it is necessary in the case of lead-containing brass to add at least about 0.02 weight percent lead for the purpose of ensuring the effective action of resistance to dezincification corrosion. On the other hand, with an addition of more than 0.10 weight percent antimony, the alloy becomes brittle, and particularly, the hot-processing characteristics of the alloy are deteriorated. Thus, in cases where the addition of antimony is only intended to improve the corrosion resistance, it is possible that the industrial usefulness of the alloy may be deteriorated. For these reasons, the antimony content should be between about 0.02 and 0.10 weight percent, especially in consideration of its interrelationship with tin, phosphorus and lead.

Phosphorus is added in order to suppress the dezincification corrosion, together with the addition of tin and antimony, as described above. Phosphorus is an element with high chemical activity, similar to antimony, so it can readily form compounds with iron and can affect the corrosion resistance. While deposited or solid solutions of unformed iron can produce compounds with phosphorus to improve the corrosion resistance, phosphorus is consumed by iron, so that the desired effect achieved by the addition of phosphorus is decreased. Therefore, the appropriate amount of phosphorus to be added should be determined in consideration of the amount of phosphorus which will be consumed by the iron. Moreover, with the addition of too much phosphorus, segregation is caused in the grain boundary, so that sensitivity to intergranular corrosion is significantly increased, along with a decrease in the ductility. According to the results of the experiments, in the above-described Okano's metal, if phosphorus is not added in an amount of 0.2 weight percent or more, phosphorus can hardly form a solid solution in the substrate of the alloy because phosphorus preferentially forms compounds with iron. With an addition of phosphorus in an amount of 0.2 weight percent or more, the sensitivity to grain-boundary corrosion is increased and the compounds are deposited in the grain boundary, thereby deteriorating the corrosion resistance. For this reason, the iron content should be in small amounts, as described below, and the appropriate addition range of phosphorus should be between about 0.04 and 0.15 weight percent, in consideration of its interrelationship with tin and antimony.

Moreover, because both antimony and phosphorus, as described above, have a property of readily causing segregation in the grain boundary, the combined total amount of both elements in excess of 0.20 weight percent decreases the ductility, and, particularly, the hot-processing characteristics are deteriorated. On the other hand, to ensure more stable corrosion resistance by the interaction of these elements and tin, it is preferable to add antimony and phosphorus at a combined total amount in the range of about 0.08 to 0.20 weight percent.

Iron also has the effect of making the alloy crystals very fine, thereby enhancing the strength of the alloy, although the addition of too little iron decreases this effect to an unsatisfactory extent. Because phosphorus, as described above, also has the effect of making the crystal grains very fine, somewhat to the same degree or more than that of iron, phosphorus can make a significant contribution by its synergistic effect with iron, e.g. to the degree of making the crystal grains similarly very fine, as well as improving the mechanical properties. With an addition of less than about 0.03 weight percent iron, such a synergistic effect of phosphorus and iron is not exhibited to a satisfactory extent. On the other hand, according to the results of the experiments, the solid solution of unformed or deposited iron has an adverse effect on the corrosion resistance in that it can form compounds with phosphorus, as described above, and thereby significantly decrease the adverse effect of iron on the corrosion resistance. With an addition of more than 0.4 weight percent iron, however, the amount of phosphorus-iron compounds is increased to consume phosphorus, such that the amount of phosphorus added to the substrate of the alloy becomes insufficient, thereby making it impossible to obtain the desired corrosion resistance. Furthermore, because of the possibility of compounds deposited in the grain boundary becoming high, the sensitivity to intergranular corrosion is increased. With an increase in the amount of iron-phosphorus compounds, the machinability is also decreased. Taking into consideration the improvement in the corrosion resistance and mechanical properties, the maintenance of machinability, and the economy in the use of recycled materials, the iron content should, therefore, be between about 0.03 and 0.4 weight percent.

As explained above, if the Cu content is limited to less than 63.0 weight percent, the copper alloy can be easily changed under high temperature conditions (650° C.–800° C.) to the double phase structure (the $\alpha+\beta$ phase structure) containing more than 50% of the $\beta$ phase. As a result, the superior hot forging properties make it possible to forge and form complicated shapes. However, it has also been found that if the copper content is less than 63.0 weight percent, the hot working materials, when cooled to ambient temperatures, have crystal structures in a non-equilibrium state as a result of being exposed to the high temperatures of hot working. For instance, when material is heated at 650° C.–800° C. at the time of forging in the hot forging processing, and if hot extrusion material is used as the forging material, it is also exposed to high temperatures at the time of the hot extrusion. As a result, the $\beta$ phase remains and, at the same time, low melting point elements such as Sn, Sb, P and others exist mainly at the grain boundary in a local maldistribution state.

While the $\beta$ phase is necessary to improve the hot working properties, as noted above, it causes the corrosion resistance (resistance against dezincification corrosion and intergranular corrosion) to be lowered. Remaining $\beta$ phase, however small the amount of the remaining $\beta$ phase, greatly affects and decreases the corrosion resistance. The degree of the decrease in the corrosion resistance worsens as a result of the above-mentioned maldistributed existence of Sb and others at the crystalline grain boundary.

However, it has been found that copper-based alloys with a copper content of less than 63.0 weight percent exhibit quite different characteristics. In this regard, it has been found that when the copper content is less than 63.0 weight percent, the alloy has improved hot working properties but has greatly reduced corrosion resistance. On the other hand, if the copper content is more than 63.0 weight percent, the alloy has improved corrosion resistance, but has decreased hot working properties. These are, therefore, conflicting demands for the copper-based alloy, i.e. to exhibit both superior hot working properties and improved corrosion resistance. The usual copper-based alloy cannot satisfy both demands, and it is to this dilemma that the present invention is directed.

According to the present invention, such conflicting demands are satisfied by making the alloy with the above-mentioned compositions and subjecting the alloy to hot working and to a specific heat treatment. The disadvantage (lowered corrosion resistance) caused by the limitation of the copper content being less than 63.0 weight percent, which is necessitated to improve the hot working properties, is eliminated by the heat treatment. That is to say, the heat treatment of the hot working material changes the $\beta$ phase left in the hot working material to the $\alpha$ phase and makes the alloy structure a substantially $\alpha$ single-phase structure. At the same time, the heat treatment disperses at even concentrations in the whole alloy structure the addition elements such as Sn, Sb and others which exist at the crystalline grain boundary in the maldistribution state. The hot working material thus obtained with the $\alpha$ single-phase structure and with the addition elements existing in the non-maldistribution state is very superior in regard to corrosion resistance. The corrosion resistance of the copper alloy subjected to such heat treatment is greatly improved and far surpasses that of the copper alloy whose Cu content is more than 63.0 weight percent.

Moreover, regardless of the contents of the addition elements, the corrosion resistance is stable and quality fluctuation of hot processing material is eliminated. Besides, the present heat treatment is also effective to prevent lowering of ductility due to elevation of concentration of tin, antimony and phosphorus in the crystal grain boundary.

The heat treatment, conducted on the hot working material and on the hot working material obtained through plural hot working steps, is to be done after the final hot working. For example, in the case of hot forging of hot extruded material obtained by hot extrusion of an ingot, the heat treatment is applied after the hot forging, not after the hot extrusion. The heat treatment is intended to, as mentioned above, provide uniform dispersion of antimony and other addition elements scattered about in the crystal grain boundary, as well as to provide the $\alpha$ single-phase structure by transformation of the remaining $\beta$ phase into the $\alpha$ phase. This should be clearly distinguished from general heat treatment (annealing), which is done after cold processing, and the present heat treating temperatures and treating times may be extremely low and short, as compared with the conditions of general heat treatment, i.e. annealing. According to experiments by the present inventors, if the heat treating temperature is over 600° C., it is difficult to entirely eliminate the $\beta$ phase, and if less than 500° C., it takes longer times to remove the local segregation of elements in the crystal grain boundary and to eliminate the $\beta$ phase. Also, if the heat treating time is less than 30 minutes, the effects of heat treatment are not clearly exhibited, but if the time exceeds 3 hours, the effects are not significantly further unchanged, and the longer time is a waste, economically. It is, hence, preferred that the heat treatment of the hot working material is at the conditions of 500° C. to 600° C. for 30 minutes to 3 hours.

EXAMPLES

As examples, copper-based alloy ingots No. 1 to No. 4 having the composition shown in Table 1 were hot extruded into bars of 20 mm in diameter, and the hot extruded materials were heated at 550° C. for 30 minutes. Materials No. 1 to No. 4 of the invention were obtained.

As comparative examples, copper-based alloy ingots No. 6 to No. 15 having the composition shown in Table 1 were hot extruded at the same conditions as above to obtain hot extruded materials No. 6 to No. 15, in the form of bars of 20 mm in diameter. The alloy compositions No. 12 to No. 15 are the same as that of the invention, except that the copper content is over 63 weight percent. No. 6 corresponds to free-cutting brass (CDA-C36000), No. 7 to forging brass (CDA-C37700), No. 8 to naval brass (CDA-C46400), No. 9 to high-tensile brass (CDA-C67800), No. 10 to CDA-C35330, and No. 11 to Okano's metal (U.S. Pat. No. 4,101,317).

No. 1 to No. 4 and No. 6 to No. 12 were tested to evaluate the mechanical properties (tensile strength, elongation, hardness) and machinability, and the results are shown in Table 2. The machinability was evaluated by the score of the drill test applied in the CDA standard. This drill test score indicates the ratio of the drilling time to free-cutting brass, and the greater the value, the superior the machinability.

As is clear from the test results in Table 2, although the extruded materials No. 1 to No. 4 of the invention contain relatively high levels of tin, phosphorus and antimony which work to decrease the elongation while enhancing the corrosion resistance, since these are uniformly solidified in the structural texture, the elongation is not lowered, and moreover since lead is contained in the alloy, the machinability is far superior to that of naval brass (No. 8) or high-tensile brass (No. 9), and is equivalent to that of the other comparative examples.

In No. 1 to No. 4 and No. 6 to No. 15, the dezincification corrosion test was conducted in accordance with the method specified in ISO 6509. This test was done on both heat treated samples and non-heat treated samples of each extruded material. That is, in No. 1 to No. 4 and No. 12 to No. 15, hot extruded bars were cooled in air but not heat treated, and hot extruded bars were heat treated at the conditions of 550° C. for 30 minutes. In No. 6 to No. 11, hot extruded bars were cooled in air but not heat treated, and hot extruded bars were heat treated at the conditions of 550° C. for 3 hours.

In the dezincification corrosion test, samples obtained from the heat treated materials and non-heat treated materials were buried in phenol resin material so that the exposure sample surface might be at a right angle to the extruding direction of the extruded material, and the sample surface was polished by emery to No. 1200 fineness and ultrasonically washed in purified water and dried. The thus-obtained samples were immersed in aqueous solution (12.7 g/l) of 1.0% copper (II) chloride dihydrate salt ($CuCl_2\ 2H_2O$), and held for 24 hours at 75° C., and taken out of the aqueous solution, and photographed by microscope to observe the progress of dezincification and grain boundary corrosion, and the mode of corrosion was judged, while the maximum and mean values of the dezincification corrosion depth were measured.

The results (maximum and mean depth of dezincification corrosion, and mode of corrosion) are shown in Table 3. The microscopic photographs are metal structure of the section at a right angle to the exposure surface of the corrosion test samples, magnified 200 times or 100 times, and several of them are shown in FIGS. 1 to 8. FIG. 1 relates to heat treated material No. 1, FIG. 2 to heat treated material No. 2, FIG. 3 to heat treated material No. 12, FIG. 4 to non-heat treated material No. 1, FIG. 5 to non-heat treated material No. 7, FIG. 6 to non-heat treated material No. 8, FIG. 7 to heat treated material No. 10, and FIG. 8 to heat treated material No. 11.

As easily seen from Table 3, in the alloy compositions specified by the invention (No. 1 to No. 4), since the copper content is less than 63 weight percent, the corrosion resistance is very poor if not heat treated, but the corrosion resistance is notably enhanced when heat treated. That is, the degree of improvement of corrosion resistance is far beyond the degree of corrosion resistance in non-heat treated materials No. 12 to No. 15 (the same compositions as No. 1 to No. 4, except that the copper content is over 63 weight percent). The depth of dezincification corrosion is much smaller than the allowable dezincification corrosion depth of BS2872-1989 which is the same test method as the ISO 6509, and the allowable dezincification corrosion depth of AS2345-1992.

While, as is clear from the test results of No. 12 to No. 15, if the copper content is over 63 weight percent, without heat treatment, the corrosion resistance is superior to that of non-heat treated samples No. 1 to No. 4 which have less than 63 weight percent copper, there is a large variance in the degree of corrosion resistance depending on the alloy composition. This variance is eliminated by heat treatment, and it is seen that a stable corrosion resistance of the heat treated materials of No. 1 to No. 4 may be assured. On the other hand, in No. 6 to No. 11 which differ from the present composition in respect of addition elements other than copper, the corrosion resistance is hardly improved by heat treatment. As is clear from this aspect, the effect of heat treatment is exhibited by defining the addition elements other than copper within the scope of the invention, regardless of the copper content, and if out of this scope, it is seen that the corrosion resistance is not improved even by heat treatment. In other words, in the hot working material specified by the invention, by applying the present heat treatment after the final hot working, regardless of the composition, a stable corrosion resistance may be always assured, so that hot working materials of uniform quality may be obtained.

The materials, not subjected to the heat treatment, No. 2 through No. 4, No. 12 and No. 15 having a diameter of 20 mm were subjected to the cutting operation with a lathe and a plurality of rod-shaped samples (measuring 15 mm in diameter and 25 mm in length) were obtained. The samples No. 2 through No. 4, No. 14 and No. 15, after heated at 725° C. to 800° C., were hot compressed in the axial direction at a compression rate of about 70% (i.e. the sample of 25 mm in length is compressed to measure about 7.5 mm). The forms of the surface after the compression are shown in FIGS. 9 through 13.

Figure 9:
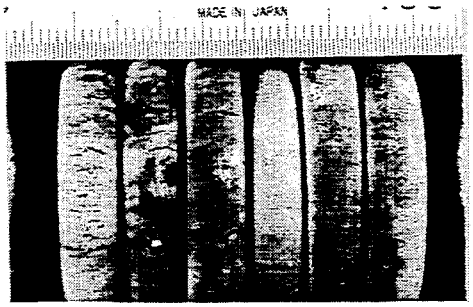
FIG. 9 is a photograph showing the surface status by hot compression of hot extruded material No. 2.

FIG. 9 shows the case where six samples of No. 2 were subjected to the hot compression at different temperatures (the six samples of No. 2 in FIG. 9 from left to right at 725° C., 725° C., 750° C., 775° C., 800° C. and 800° C., respectively).

Figure 10:
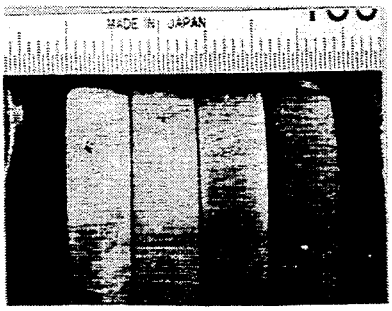
FIG. 10 is a photograph showing the surface status by hot compression of hot extruded material No. 3.

FIG. 10 shows the case where four samples of No. 3 were subjected to the hot compression at different temperatures (the four samples of No. 3 in FIG. 10 from left to right at 725° C., 750° C., 775° C., and 800° C., respectively).

Figure 11:
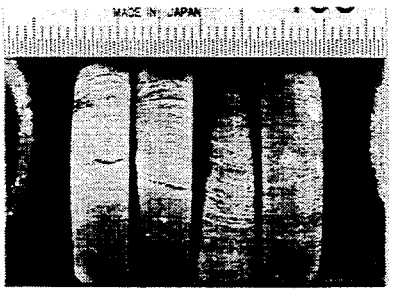
FIG. 11 is a photograph showing the surface status by hot compression of hot extruded material No. 4.

FIG. 11 shows the case where four samples of No. 4 were subjected to the hot compression at different temperatures (the four samples of No. 4 in FIG. 11 from left to right at 725° C., 750° C., 775° C., and 800° C., respectively).

Figure 12:
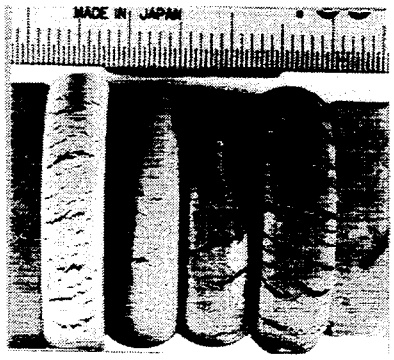
FIG. 12 is a photograph showing the surface status by hot compression of hot extruded material No. 14.

FIG. 12 shows the case where four samples of No. 14 were subjected to the hot compression at different temperatures (the four samples of No. 14 in FIG. 12 from left to right at 725° C., 750° C., 775° C., and 800° C., respectively).

Figure 13:
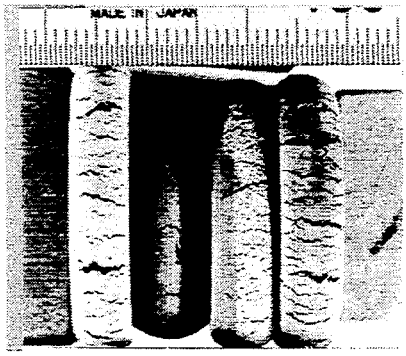
FIG. 13 is a photograph showing the surface status by hot compression of hot extruded material No. 15.

FIG. 13 shows the case where four samples of No. 15 were subjected to the hot compression at different temperatures (the four samples of No. 15 in FIG. 13 from left to right at 725° C., 750° C., 775° C., and 800° C., respectively).

No. 3 (Cu of 62.30 weight percent): As can be seen from FIG. 10, none of the four samples have cracks irrespective of the heating temperatures. No. 3 is very appropriate for the practical forging processing.

No. 4 (Cu of 62.53 weight percent): No. 4 has no problems when subjected to a practical forging operation since the hot forging properties are as high as the point where only the samples subjected to the hot compression at 725° C. and 750° C. have some cracks, as seen from FIG. 11.

No. 14 (Cu of 63.59 weight percent): As can be seen from FIG. 12, all the four samples have large cracks irrespective of the heating temperatures. No. 14 is not appropriate as a practical material for forging.

No. 15 (Cu of 63.18 weight percent): As can be seen from FIG. 13, all the samples have large cracks irrespective of the heating temperatures. No. 15, like No. 14, is not appropriate as a practical material for forging.

No. 2 (Cu of 62.96 weight percent): As can be seen from FIG. 9, the hot working properties vary somewhat between the six samples, some having no cracks while some have small cracks. It is understood that in comparison with No. 14 and No. 15, No. 2 clearly has high hot working properties. No. 2 with these high hot working properties has no problems when subjected to a practical forging operation if the forging conditions are limited to some extent.

It can be seen from the test results that, as the Cu content of the alloy increases to at or more than 63 weight percent, the corrosion resistance improves but the hot forging properties seriously decline. It can also be seen that, conversely, as the Cu content of the alloy decreases to less than 63 weight percent, the hot forging properties improve, but the corrosion resistance decreases. However, the corrosion resistance is drastically improved, irrespective of the Cu content, by subjecting the hot working material to the present heat treatment, making it possible to obtain a stable corrosion resistance.

Figure 14:
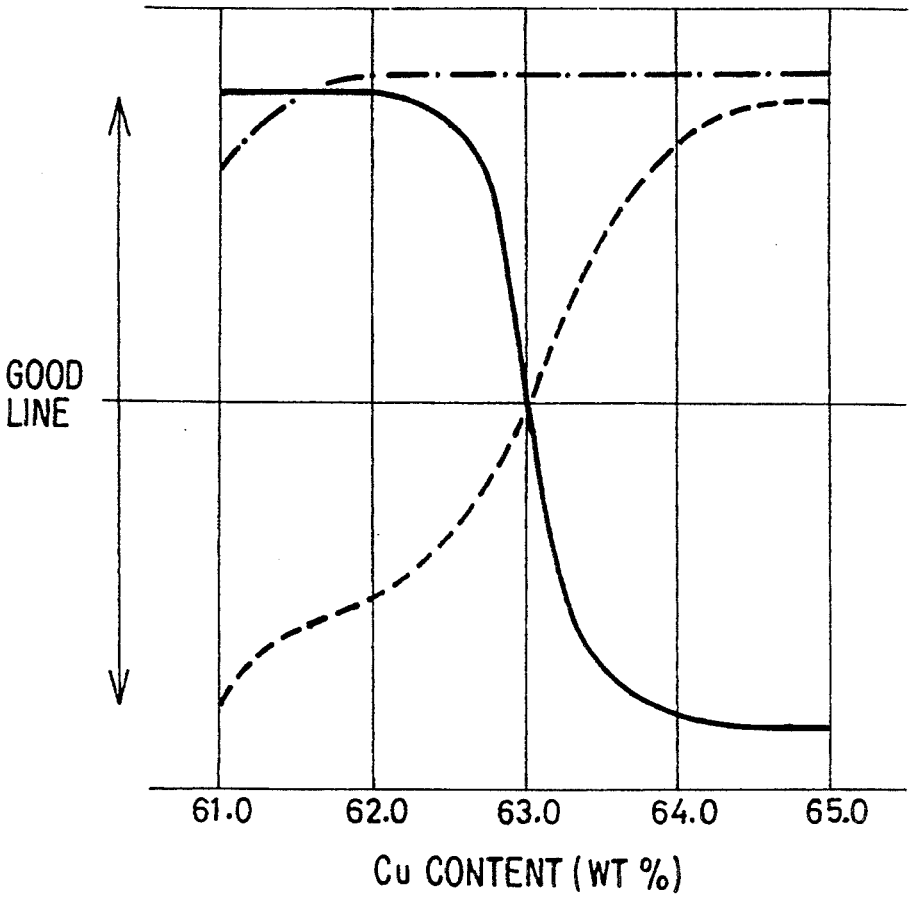
FIG. 14 is a graph showing the relation of copper content, hot forging performance, and corrosion resistance.

FIG. 14 is a graph indicating such correlations between the Cu content, the hot forging properties and corrosion resistance. The axis of the ordinate in the graph indicates that degree of the hot forging properties and the corrosion resistance while the axis of the abscissa indicates the Cu content. Further, the solid line indicates the hot forging properties, the broken line the corrosion resistance obtained when the heat treatment is not conducted, and the one dot broken line the corrosion resistance obtained when the heat treatment is conducted. The base line designated as the "Good" line is a critical line for judging whether the forging properties and the corrosion resistance are practical for application and industrial productions. The region above the "Good" line indicates where the forging properties and the corrosion resistance are practical, while the region below that line indicates where they are not. Practicality is increased as the location goes up in the region above the "Good" line. As can be seen from this graph, to be above the "Good" line, the copper content of the alloy must be less than 63 weight percent.

Figure 16:
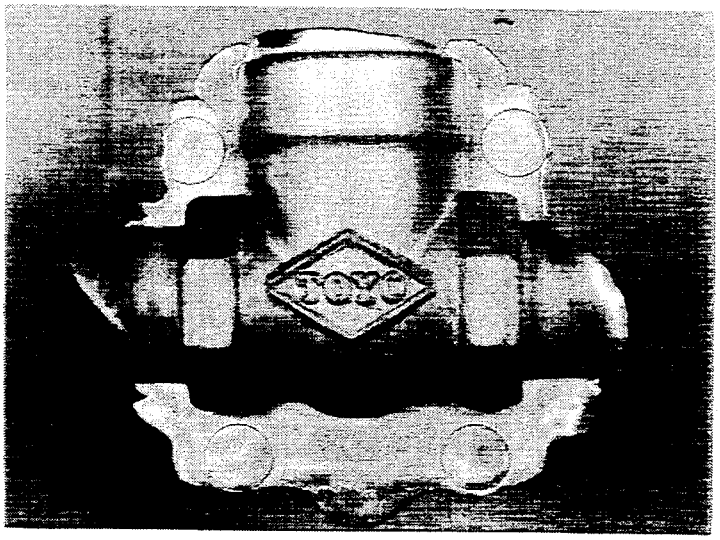
FIG. 16 is a photograph showing the appearance of hot forged material No. 5 being hot forged at 725° C. in a shape shown in FIG. 15.
Figure 17:
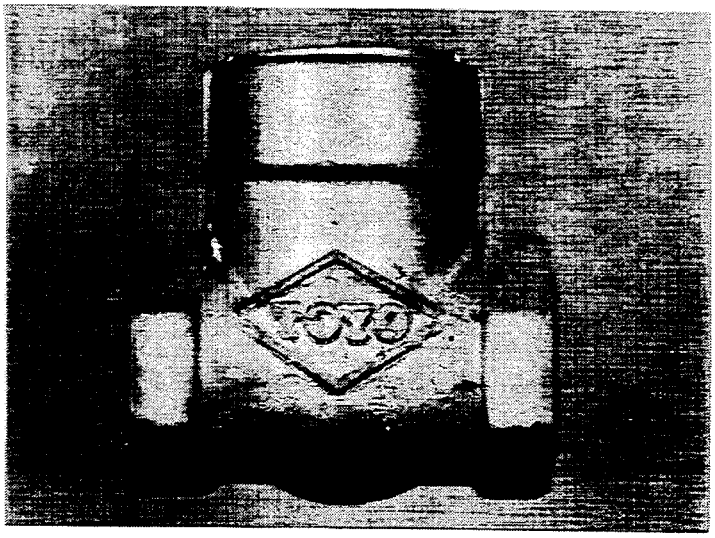
FIG. 17 is a photograph showing the appearance of hot forged material No. 5 after being hot forged at 750° C. in the same shape.
Figure 18:
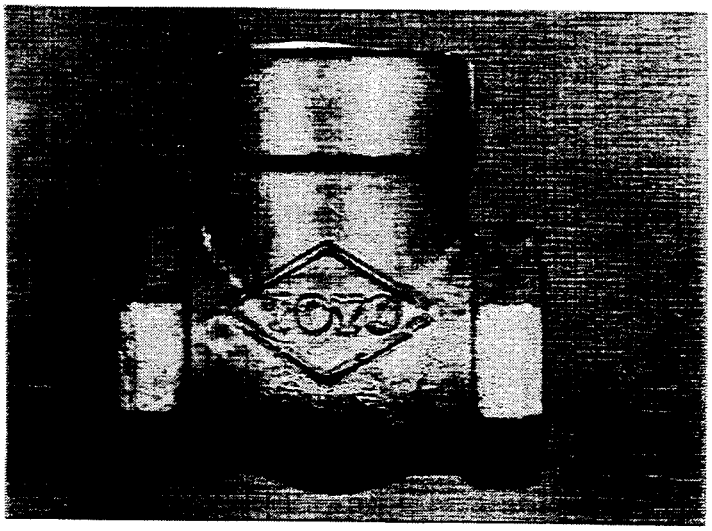
FIG. 18 is a photograph showing the appearance of hot forged material No. 5 after being hot forged at 775° C. in the same shape.
Figure 19:
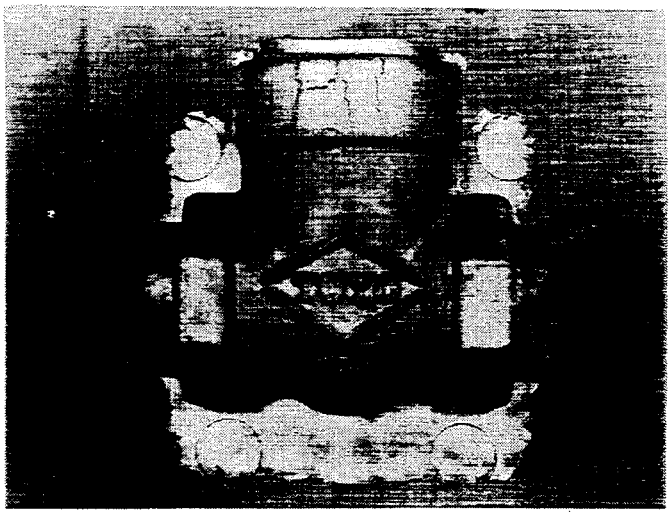
FIG. 19 is a photograph showing the appearance of hot forged material No. 16 after being hot forged at 725° C. in the same shape.
Figure 20:
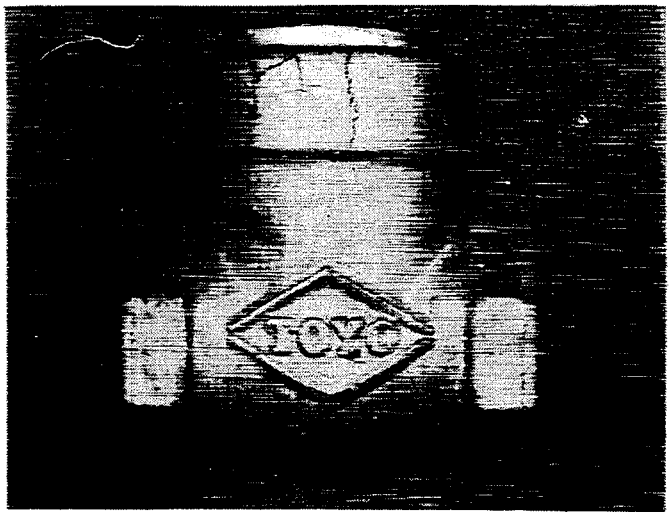
FIG. 20 is a photograph showing the appearance of hot forged material No. 16 after being hot forged at 750° C. in the same shape.
Figure 21:
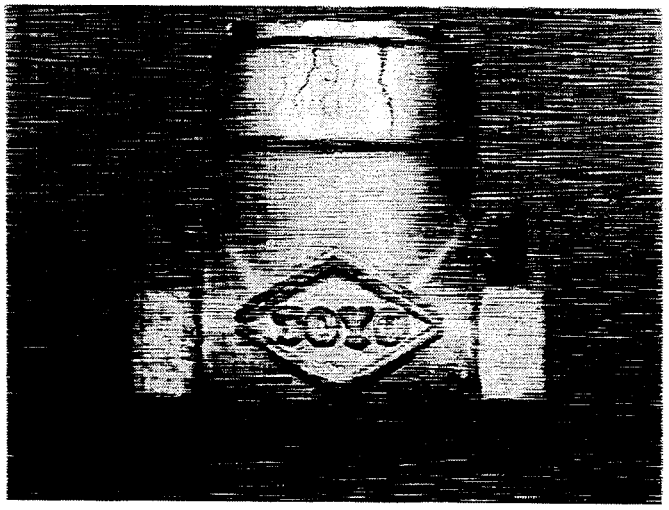
FIG. 21 is a photograph showing the appearance of hot forged material No. 16 after being hot forged at 775° C. in the same shape.

With No. 5, i.e. with the copper content of 62.66 weight percent, as shown in FIGS. 16 to 18, favorable forged pieces were obtained regardless of the heating temperature. On the other hand, with No. 16, i.e. with the copper content of 63.31 weight percent, although other additive elements are within the specified scope of the invention, i.e. the same as in No. 5, large cracks were formed regardless of the heating temperature. As shown in FIGS. 19 to 21, the hot forging performance was poor, and it is understood that practical forging is impossible. This result coincides with the result of the hot compressing test mentioned above, which proves that the hot forging performance varies drastically if the copper content is only slightly increased or decreased from the very critical boundary of 63 weight percent.

As easily understood from the test results, the invention provides hot working materials which are excellent in both hot working properties (especially hot forging performance) and corrosion resistance.

TABLE 1

| Alloy No. | Alloy composition (wt %) | | | | | | | | | | |
|---|---|---|---|---|---|---|---|---|---|---|---|
| | Cu | Pb | Sn | Fe | Ni | Sb | P | Mn | Al | As | Zn |
| Examples | | | | | | | | | | | |
| 1 | 61.75 | 2.78 | 0.92 | 0.23 | 0.57 | 0.07 | 0.04 | — | — | — | Balance |
| 2 | 62.96 | 1.78 | 1.10 | 0.18 | 0.42 | 0.05 | 0.07 | — | — | — | Balance |
| 3 | 62.30 | 1.98 | 0.86 | 0.26 | 0.48 | 0.05 | 0.05 | — | — | — | Balance |
| 4 | 62.53 | 1.96 | 0.83 | 0.26 | 0.44 | 0.05 | 0.06 | — | — | — | Balance |
| 5 | 62.66 | 2.05 | 0.79 | 0.16 | 0.32 | 0.04 | 0.06 | — | — | — | Balance |
| Comparative examples | | | | | | | | | | | |
| 6 | 58.58 | 3.12 | 0.26 | 0.25 | 0.07 | — | — | — | — | — | Balance |
| 7 | 58.86 | 2.08 | 0.29 | 0.24 | 0.10 | — | — | — | — | — | Balance |
| 8 | 60.23 | 0.04 | 0.79 | 0.06 | — | — | — | — | — | — | Balance |
| 9 | 57.45 | 0.31 | 0.17 | 0.46 | 0.04 | — | — | 0.81 | 0.70 | — | Balance |
| 10 | 62.81 | 1.97 | 0.05 | 0.03 | 0.14 | — | — | — | — | 0.25 | Balance |
| 11 | 64.27 | 1.84 | 1.45 | 0.79 | 0.71 | — | — | — | — | — | Balance |
| 12 | 64.10 | 2.23 | 0.78 | 0.30 | 0.37 | 0.03 | 0.11 | — | — | — | Balance |
| 13 | 63.25 | 1.89 | 0.97 | 0.25 | 0.51 | 0.07 | 0.08 | — | — | — | Balance |
| 14 | 63.59 | 1.93 | 0.88 | 0.25 | 0.41 | 0.05 | 0.06 | — | — | — | Balance |
| 15 | 63.18 | 1.99 | 0.92 | 0.28 | 0.39 | 0.04 | 0.07 | — | — | — | Balance |
| 16 | 63.31 | 1.90 | 0.81 | 0.34 | 0.36 | 0.03 | 0.02 | — | — | — | Balance |

The invention is further confirmed by the following experiment which shows that the copper content has the same effects on the hot forging performance when hot forged into practical complicated shapes, i.e. not limited to simply round bar shapes.

Figure 15:
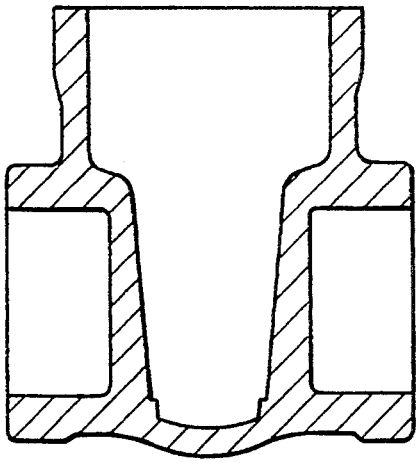
FIG. 15 is a sectional view of hot forged material.

Thus, copper-based alloy ingots of No. 5 and No. 16 of Table 1 were hot extruded into bars of 28 mm in diameter, and three forged materials were obtained from each. Each forged material was heated to 725° C., 750° C. and 775° C., and hot forged into a valve body in the shape shown in FIG. 15.

The results were as shown in FIGS. 16 to 21. FIGS. 16 to 18 show photographs of a valve body formed from composition No. 5 and hot forged at 725° C., 750° C. and 775° C., respectively. FIGS. 19 to 21 show photographs of a valve body formed from composition No. 16 and hot forged at 725° C., 750° C. and 775° C., respectively.

TABLE 2

| Alloy No. | Mechanical properties | | | Machinability Drill-test value % |
|---|---|---|---|---|
| | Tensile strength $N/mm^2$ | Elongation % | Hardness HR (B) | |
| Examples | | | | |
| 1 | 452 | 26.8 | 68 | 91 |
| 2 | 453 | 36.4 | 69 | 68 |
| 3 | 455 | 34.8 | 70 | 69 |
| 4 | 443 | 37.0 | 67 | 71 |
| Comparative examples | | | | |
| 6 | 441 | 25.4 | 66 | 100 |
| 7 | 458 | 33.4 | 69 | 72 |
| 8 | 429 | 37.8 | 64 | 20 |
| 9 | 646 | 18.0 | 81 | 20 |
| 10 | 394 | 24.2 | 64 | 74 |
| 11 | 464 | 22.6 | 73 | 52 |
| 12 | 455 | 29.8 | 70 | 73 |

TABLE 3

| Alloy No. | Heat treatment | | | | | |
|---|---|---|---|---|---|---|
| | Untreated | | | Treated | | |
| | Depth of dezincification corrosion | | | Depth of dezincificatiou corrosion | | |
| | Maximum (mm) | Average (mm) | Corrosion form | Maximum (mm) | Average (mm) | Corrosion form |
| 1 | 0.3 | 0.18 or less | Intergranular corrosion | 0.03 | 0.01 or less | Intergranular corrosion |
| 2 | 0.26 | 0.12 or less | Intergranular corrosion | 0.02 | 0.01 or less | Intergranular corrosion |
| 3 | 0.39 | 0.19 or less | Intergranular corrosion | 0.04 | 0.01 or less | Intergranular corrosion |
| 4 | 0.28 | 0.14 or less | Intergranular corrosion | 0.03 | 0.01 or less | Intergranular corrosion |
| 6 | 1.2 | 1.00 | Overall corrosion | 1.0 | 0.95 | Overall corrosion |

TABLE 3-continued

| | Heat treatment | | | | | |
|---|---|---|---|---|---|---|
| | Untreated | | | Treated | | |
| | Depth of dezincification corrosion | | | Depth of dezincificatiou corrosion | | |
| Alloy No. | Maximum (mm) | Average (mm) | Corrosion form | Maximum (mm) | Average (mm) | Corrosion form |
| 7 | 1.1 | 0.90 | Overall corrosion | 1.0 | 0.85 | Overall corrosion |
| 8 | 0.6 | 0.42 | Overall corrosion | 0.5 | 0.40 | Overall corrosion |
| 9 | 0.8 | 0.52 | Overall corrosion | 0.7 | 0.55 | Overall corrosion |
| 10 | 0.31 | 0.14 | Intergranular corrosion | 0.13 | 0.10 | Intergranular corrosion |
| 11 | 0.28 | 0.12 | γ-selective corrosion | 0.18 | 0.10 | γ-selective corrosion |
| 12 | 0.07 | 0.03 or less | Intergranular corrosion | 0.02 | 0.01 or less | Intergranular corrosion |
| 13 | 0.13 | 0.04 or less | Intergranular corrosion | 0.02 | 0.01 or less | Intergranular corrosion |
| 14 | 0.21 | 0.06 or less | Intergranular corrosion | 0.02 | 0.01 or less | Intergranular corrosion |
| 15 | 0.19 | 0.08 or less | Intergranular corrosion | 0.02 | 0.01 or less | Intergranular corrosion |

What is claimed is:

1. In a hot working material of corrosion resistant copper-based alloy having a metal composition comprising lead, tin, nickel, iron, antimony, phosphorus and at least 63% copper, with the balance composed of zinc and inevitable accompanying impurities, the improvement wherein the composition comprises 61.0 weight percent to less than 63.0 weight percent copper, 1.0 weight percent to 3.5 weight percent lead, 0.7 weight percent to 1.2 weight percent tin, 0.2 weight percent to 0.7 weight percent nickel, 0.03 weight percent to 0.4 weight percent iron, 0.02 weight percent to 0.10 weight percent antimony, and 0.04 weight percent to 0.15 weight percent phosphorus, with the balance compose of zinc and inevitable accompanying impurities, produced by the process of subjecting the alloy to hot working and subsequent heat treatment at temperatures of from 500° C. to 600° C. for 30 minutes to 3 hours wherein the alloy has an α single-phase structure, and addition elements are dispersed uniformly in the entire structure, and whereby the mechanical and corrosion resistance properties of the alloy are maintained and the hot forging properties are improved.

2. A hot working material of claim 1, wherein the hot working comprises hot extruding the material from an ingot.

3. A hot working material of claim 1, wherein the hot working comprises hot forging of extruded material or drawn material.

4. A hot working material of claim 3, wherein the hot forging forms a part for a valve which requires corrosion resistance.

5. A hot working material of claim 1, wherein the total content of antimony and phosphorus is 0.08 weight percent to 0.20 weight percent.

6. A hot working material of claim 1, wherein the total content of tin and nickel is 1.0 weight percent to 1.6 weight percent.

7. A hot working material of claim 1, wherein the total content of copper and nickel is at least 61.5 weight percent.

* * * * *